US006148466A

United States Patent [19]

Smitelli, III et al.

[11] Patent Number: 6,148,466

[45] Date of Patent: Nov. 21, 2000

[54] SIDE SURFACE AND CORNER POOL BRUSH

[76] Inventors: Joseph J. Smitelli, III, 5150 Pintail La.; J. Spencer Hardern, 5140 Pintail La., both of Merritt Island, Fla. 32953

[21] Appl. No.: 09/288,387

[22] Filed: Apr. 8, 1999

[51] Int. Cl.[7] ..... A46B 9/02; A46B 15/00; E04H 4/16

[52] U.S. Cl. ..... 15/160; 15/1.7; 15/159.1; 15/172; D4/130; D32/50; D32/51

[58] Field of Search ..... 15/1.7, 159.1, 15/160, 171, 172; D4/127, 128, 130, 132–135; D32/50, 51

[56] References Cited

U.S. PATENT DOCUMENTS

| | | | |
|---|---|---|---|
| D. 257,521 | 11/1980 | Piero | D4/118 |
| D. 269,649 | 7/1983 | Jones et al. | D4/135 |
| D. 351,948 | 11/1994 | Getchell | D4/132 |
| 702,136 | 6/1902 | Isaacs | 15/160 |
| 1,749,733 | 3/1930 | Cave et al. | 15/160 |
| 2,083,134 | 6/1937 | Wood | 15/160 |
| 2,855,618 | 10/1958 | Jones | 15/160 X |
| 3,273,187 | 9/1966 | Williams | 15/1.7 |
| 3,296,643 | 1/1967 | Fortune | 15/201 |
| 3,315,296 | 4/1967 | Richardson | 15/159.1 |
| 4,176,419 | 12/1979 | MacDonald | 15/1.7 |
| 4,291,431 | 9/1981 | Lewis, Jr. | 15/159.1 |
| 4,479,277 | 10/1984 | Gilman et al. | 15/111 |
| 4,606,091 | 8/1986 | Sartori | 15/159.1 X |
| 4,637,087 | 1/1987 | Feinberg | 15/1.7 |
| 4,703,535 | 11/1987 | Nehls | 15/1.7 |
| 4,733,427 | 3/1988 | Conrad | 15/160 |
| 4,783,868 | 11/1988 | O'Callaghan | 15/1.7 |
| 5,487,397 | 1/1996 | Bean | 134/6 |

FOREIGN PATENT DOCUMENTS

| | | | |
|---|---|---|---|
| 645139 | 10/1928 | France | 15/160 |
| 1051636 | 9/1953 | France | 15/160 |
| 1123604 | 9/1956 | France | 15/159.1 |
| 19549 | of 1889 | United Kingdom | 15/172 |
| 2265822 | 10/1993 | United Kingdom | 15/160 |

*Primary Examiner*—Mark Spisich
*Attorney, Agent, or Firm*—Brian S. Steinberger; Law Offices of Brian S. Steinberger

[57] ABSTRACT

A pool brush for cleaning all narrow areas of a pool such as corners, stairs, seats, and where walls intersect as well as the intersection of where all floor areas meet the walls. The brush has a head with a substantially cylindrical body and semi-spherical rounded ends. All the brush bristles are perpendicular to and uniformly mounted approximately ¼ inch center to center from one another across all rounded surfaces of the brush head. Each of the adjacent bristles on the rounded surfaces is angled approximately 10 degrees from one another. A side cross-sectional view of the cylindrical body shows the bristles expanding outward at approximately 280 degrees.

12 Claims, 3 Drawing Sheets

SIDE SURFACE AND CORNER POOL BRUSH

SIDE, SURFACE AND CORNER POOL BRUSH

This invention relates to swimming pool cleaning devices, and in particular to a cylindrical swimming pool brush head having rounded ends with bristles perpendicularly mounted along the rounded sides so that hard to reach narrow angled areas such as corners, stairs, and seat areas can be cleaned.

BACKGROUND AND PRIOR ART

Swimming pool brushes have been around for many years. Most traditional brushes have an elongated handle connected to a brush head. See for example U.S. Pat. Nos. 351,948 to Getchell; 3,296,643 to Fortune; 4,637,087 to Feinberg; 4,703,535 to Nehls; 4,733,427 to Conrad; 4,783,868 to O'Callaghan; and 5,487,397 to Bean. However, these references are limited to having bristles oriented generally downward, and are not capable of adequately cleaning all corners where walls and floors come together, areas where different planar walls intersect, edge areas where walls meet floors, around stairs, seats and the like.

U.S. Pat. No. Des. 257,521 to Piero; and 4,176,419 to MacDonald each describe other pool brushes where the bristles are only oriented about part of the perimeter edges of the brush head, and are also not capable of adequately cleaning all corners where walls and floors come together, areas where different planar walls intersect, edge areas where walls meet floors, around stairs, seats and the like.

U.S. Pat. No. 2,083,134 to Wood shows a complex brush for "cleaning vats" having separately positioned bristle heads attached to two parallel brush heads, and also would not appear to be capable of adequately cleaning all corners where walls and floors come together, areas where different planar walls intersect, edge areas where walls meet floors, around stairs, seats and the like.

U.S. Pat. No. 3,273,187 to Williams shows a triangular "vacuum cleaner head" of bristles that would be difficult to maneuver and use for adequately cleaning all corners where walls and floors come together, areas where different planar walls intersect, edge areas where walls meet floors, around stairs, seats and the like.

U.S. Pat. No. 4,479,277 to Gilman et al. describes a scrub pad brush with downwardly oriented bristles and one side edge having rounded edge bristles. However, Gilman requires a handle parallel to a small rectangular pad brush head with only rounded bristles on one side edge and does not describe any application for cleaning pools and can not be used for adequately cleaning all corners where walls and floors come together, areas where different planar walls intersect, edge areas where walls meet floors, around stairs, seats and the like.

SUMMARY OF THE INVENTION

The primary objective of the present invention is to provide a simple, efficient pool brush for easily cleaning all corners where walls and floors come together, areas where different planar walls intersect, edge areas where walls meet floors, around stairs, seats and the like, while simultaneously being able to clean all other surface areas of a pool.

The second object of this invention is to provide a novel pool brush having straight bristles perpendicularly connected to the cylindrical sides and rounded edges of the brush head.

A preferred embodiment of the pool brush includes an elongated handle having an upper end and a lower end and a handle length, a brush head having a 2 inch diameter cylindrical body with rounded front, bottom and rear sides. The cylindrical body having opposite semi-spherical rounded ends and a mid-portion is perpendicularly connected to the elongated handle, where the handle is longer than the 12 to 14 inch length than the cylindrical brush head.

One and ½ inch long bristles are perpendicularly mounted to the front, bottom and rear rounded surface sides, as well as to the semi-spherical rounded ends of the brush head. A cross-sectional view of the cylindrical brush head shows the brushes expanding outward in an approximately 280 degree range, each of the adjacent bristles on the rounded surface having ends approximately 10 degrees apart from one another. Each of the bristles are uniformly mounted approximately ¼ of an inch from one another on the brush head. Mounting the bristles on all the rounded surfaces of the brush head allows the pool brush to be able to clean all interior and exterior pool surface areas as well as where walls intersect, walls meet floors, around stairs, and around pool seats.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
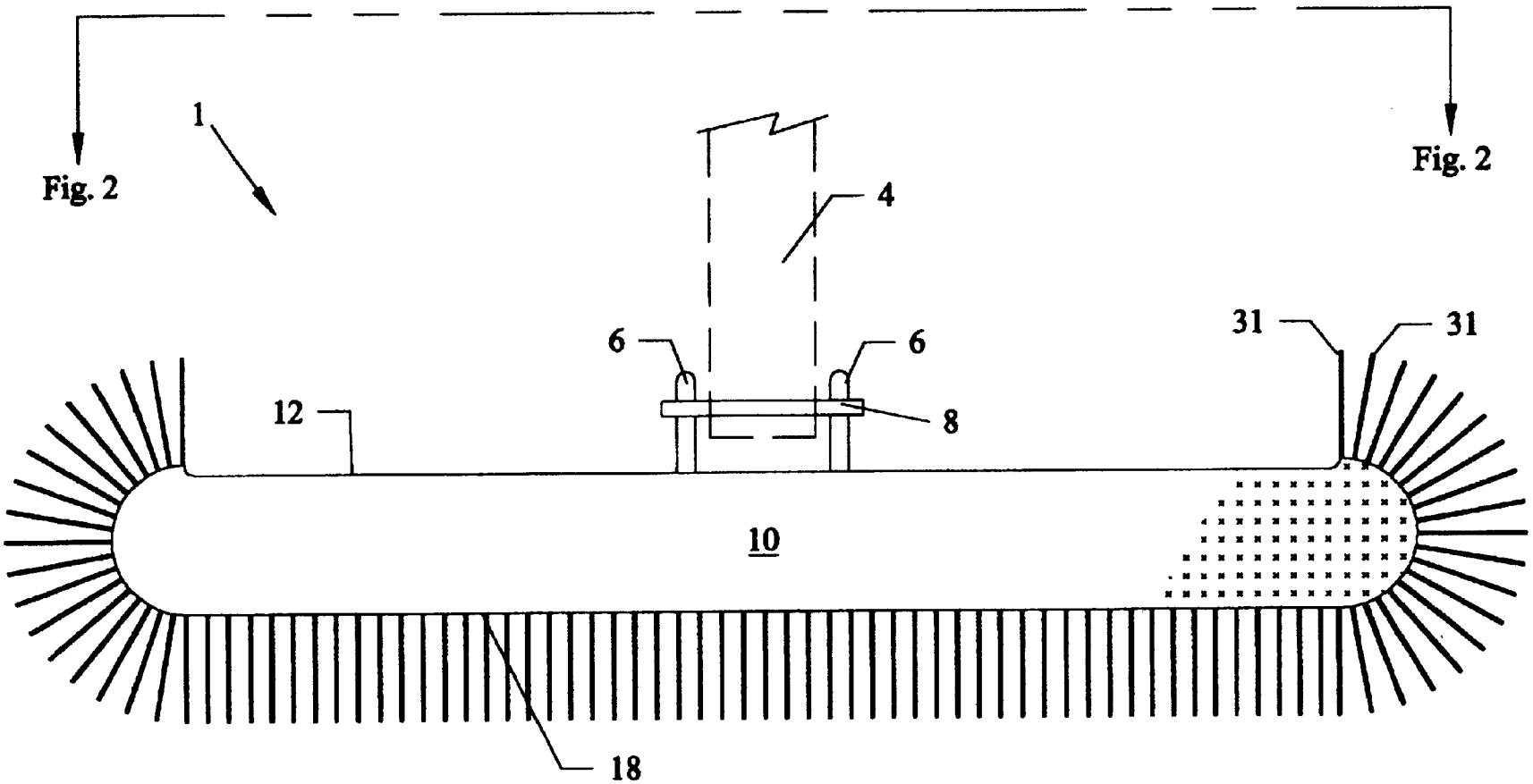
FIG. 1 is a side cross-sectional view of the novel brush head of the subject invention.
Figure 2:
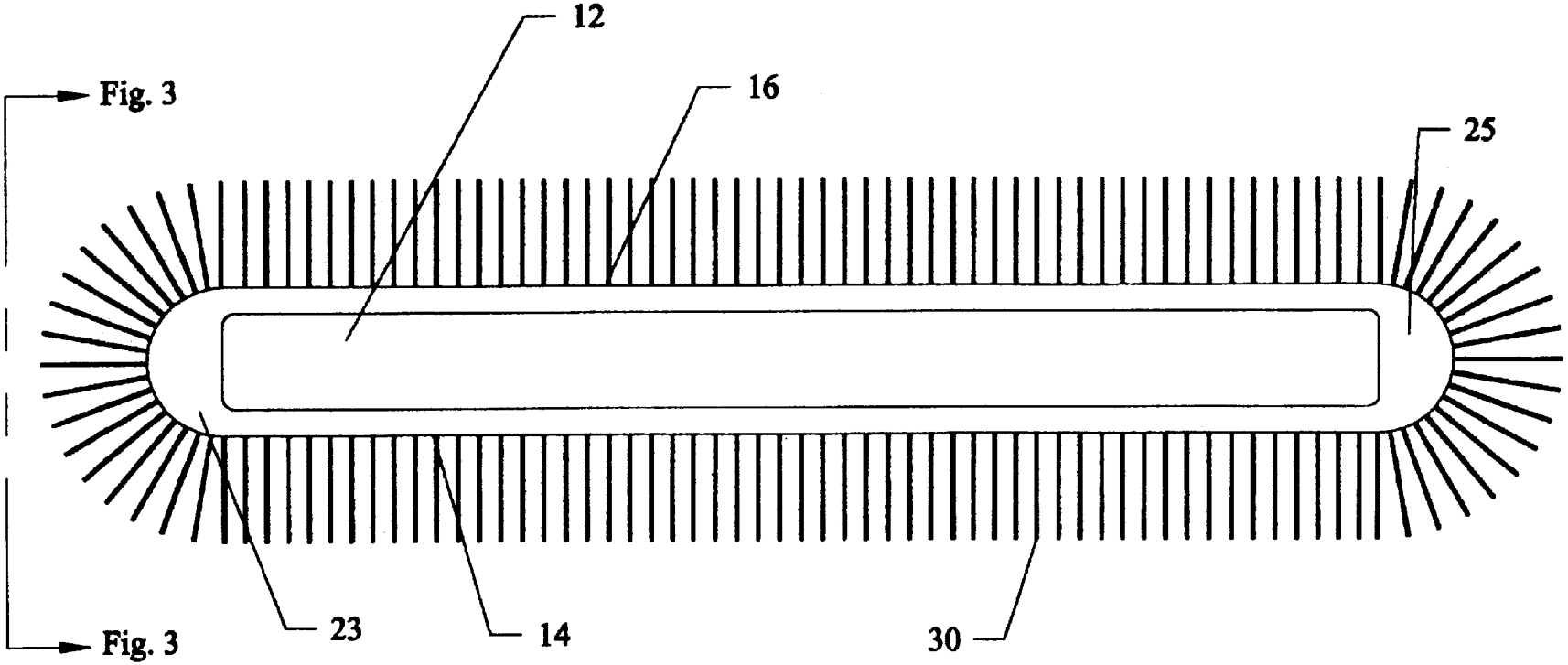
FIG. 2 is a top view of the novel brush head of FIG. 1 along arrow A.
Figure 3:
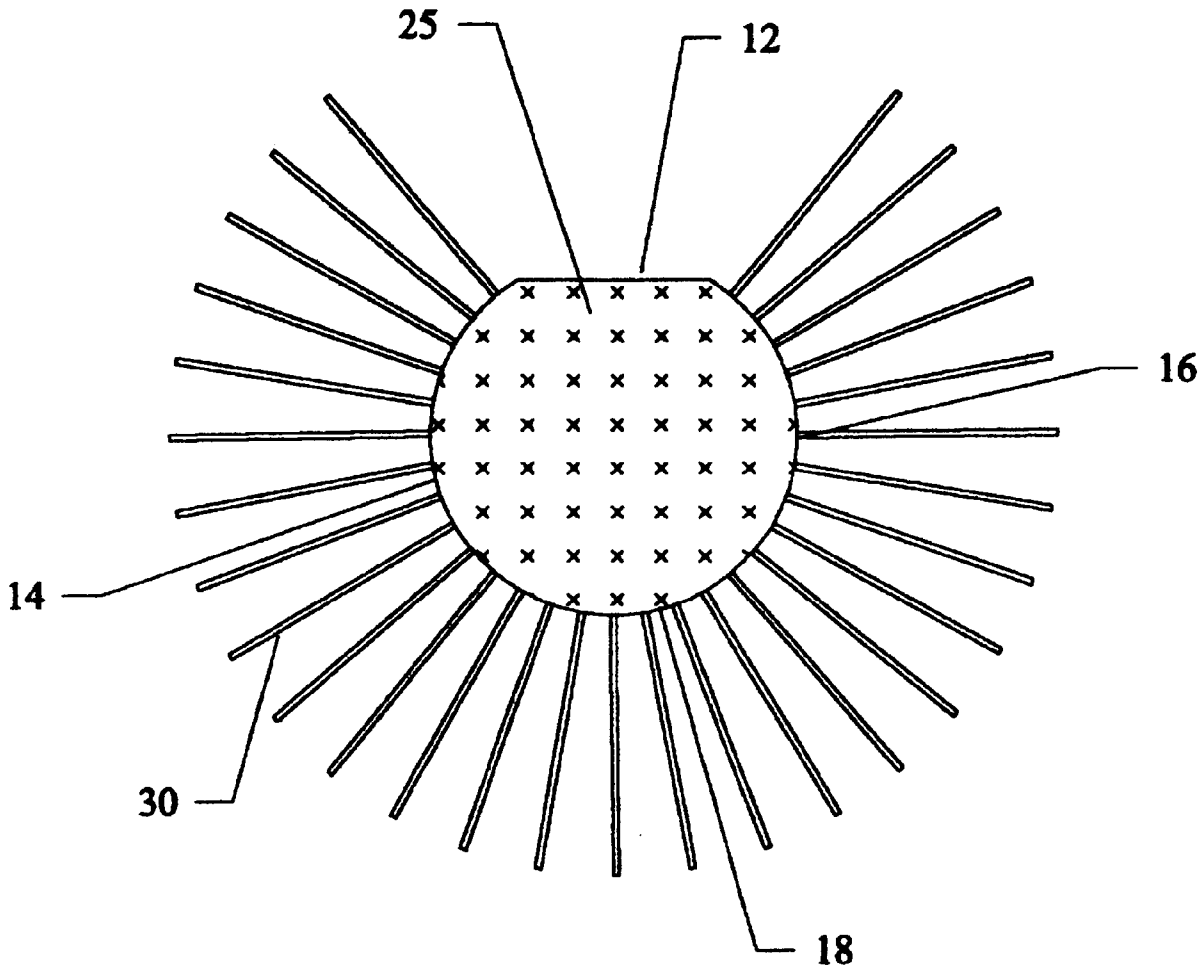
FIG. 3 is an end view of the brush head of FIG. 2 along arrow B.

FIG. 1 is a side cross-sectional view of the novel brush head 1 of the subject invention. FIG. 2 is a top view of the novel brush head of FIG. 1 along arrow A. FIG. 3 is an end view of the brush head of FIG. 2 along arrow B. Referring to FIGS. 1–3, brush head 1 includes a longitudinal handle 4 having a bottom end which can be connected to a mid-portion of brush head cylindrical body 10 by vertical posts 6 and pivot pin 8, the latter of which can allow the handle 4 to rotate at a fixed perpendicular angle to cylindrical body 10. Cylindrical body 10, has a flat top portion 12, front rounded side 14 rounded bottom 18 and rear rounded side 16, and can have an overall length of approximately 13 and ½ inches, a diameter of approximately 2 inches. Opposite ends 23 and 25 can be semi-spherical halve section having a radius of approximately 1 inch. The flat top portion 12 can have a width of approximately 1 and ¼ inches. Cylindrical body 10 can be formed from injection molded plastic, metal such as aluminum and the like.

Each of the bristles 30 can be approximately 1 and ¼ inches long metal, plastic wire and the like, and be uniformly mounted apart from one another on the front, rear and bottom rounded sides 14, 16, 18 and half sections 23, 25 approximately ¼ inches center to center apart. Across all adjacent rounded surfaces, the ends 31 of the bristles can be offset approximately 10 degrees apart from one another. Semi-spherical ends 23, 25 can each have a diameter of approximately 1 and ¾ inches, and with bristles 30 can each have a radius of approximately 1 inch. The bristles 30 expand outward from rounded sides 14, 16 and 18 approximately 280 degrees.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A pool brush, comprising:

an elongated handle having an upper end and a lower end and a handle length;

a brush head having a substantially cylindrical body with a front rounded side, rear rounded side and rounded bottom, the brush head having a first semi-spherical rounded end, a second semi-spherical rounded end opposite the first semi-spherical rounded end, a mid-portion, the brush head having a head length shorter than the handle length, the mid-portion of the brush head attached to the lower end of the handle; and bristles perpendicularly mounted to the front rounded side, the rear rounded side, the bottom rounded side, the first semi-spherical rounded end, and the second semi-spherical rounded end of the brush head, wherein the pool brush cleans all surface areas as well as where walls intersect, walls meet floors, around stairs, and around pool seats.

2. The pool brush of claim 1, wherein the bristles further include:

a cross-sectional circumference of approximately 280 degrees about the front rounded side, the bottom rounded side and the rear rounded side of the brush head.

3. The pool brush of claim 1, wherein each of the bristles includes:

mounting all of the bristles uniformly apart from one another.

4. The pool brush of claim 3, wherein the mounted ends of the bristles are approximately ¼ inch center to center from one another.

5. The pool brush of claim 1, wherein the head length is:

approximately 12 to approximately 14 inches.

6. The pool brush of claim 1, wherein each of the bristles has a length of:

approximately 1 to approximately 1 and ½ inches.

7. The pool brush of claim 1, wherein each of the bristles mounted on adjacent rounded surfaces expand outwardly approximately 10 degrees from one another.

8. The pool brush of claim 1, wherein the cylindrical body has a diameter of:

approximately 2 inches.

9. A pool brush, comprising:

an elongated handle having an upper end and a lower end and a handle length;

a brush head having a substantially cylindrical body with a front rounded side, rear rounded side and rounded bottom, the brush head having a first semi-spherical rounded end, a second semi-spherical rounded end opposite the first semi-spherical rounded end, a mid-portion, the brush head having a head length shorter than the handle length, the mid-portion of the brush head attached to the lower end of the handle; and bristles perpendicularly mounted uniformally to one another onto the front rounded side, the rear rounded side, the bottom rounded side, the first rounded end, and the second rounded end of the brush head, the bristles having a cross-sectional circumference of approximately 280 degrees about the front rounded side, the bottom rounded side and the rear rounded side of the brush head, wherein the pool brush cleans all surface areas as well as where walls intersect, walls meet floors, around stairs, and around pool seats.

10. A pool brush, comprising:

an elongated handle having an upper end and a lower end and a handle length;

a brush head having a substantially cylindrical body with a front rounded side, rear rounded side and rounded bottom, the brush head having a first rounded end, a second rounded end opposite the first rounded end, a longitudinal mid-portion extending along the length of the brush head between the first rounded end and the second rounded end and between and along the front rounded side and the rear rounded side, the brush head having a head length shorter than the handle length, the mid-portion of the brush head attached to the lower end of the handle; and bristles perpendicularly mounted to the front rounded side, the rear rounded side, the bottom rounded side, so that the bristles are mounted approximately 280 degrees about sides of the head, the bristles further being perpendicularly mounted to cover substantially all of the first rounded end and the second rounded end of the brush head, and none of the bristles being mounted on the longitudinal mid-portion of the head, wherein the pool brush cleans all surface areas as well as where walls intersect, walls meet floors, around stairs, and around pool seats.

11. The pool brush of claim 10, wherein the first rounded end and the second rounded end are each semi-spherical rounded ends.

12. The pool brush of claim 10, wherein the longitudinal mid-portion includes a flat exterior surface.

* * * * *